United States Patent [19]

Appel et al.

[11] 4,375,448

[45] Mar. 1, 1983

[54] METHOD OF FORMING A WEB OF AIR-LAID DRY FIBERS

[75] Inventors: David W. Appel, Wittenberg; Raymond Chung, Neenah, both of Wis.

[73] Assignee: Kimberly-Clark Corporation, Neenah, Wis.

[21] Appl. No.: 250,546

[22] Filed: Apr. 3, 1981

Related U.S. Application Data

[63] Continuation-in-part of Ser. No. 106,144, Dec. 21, 1979, abandoned.

[51] Int. Cl.[3] ..... B29J 5/00

[52] U.S. Cl. ..... 264/518; 264/121

[58] Field of Search ..... 264/518, 121, 40.7

[56] References Cited

U.S. PATENT DOCUMENTS 3,150,215 9/1964 Houghton ..... 264/121

4,091,161 5/1978 Desverchére ..... 264/121

*Primary Examiner*—James R. Hall

*Attorney, Agent, or Firm*—Gregory E. Croft; William D. Herrick; R. Jonathan Peters

[57] ABSTRACT

A method therefor for forming an air-laid web of dry fibers suitable for use in a wide variety of products ranging from bath and facial tissues to towels having basis weights on the order of 13 lbs./2880 ft.$^2$ to 50 lbs./2880 ft.$^2$ on a high-speed production basis, wherein the web is characterized by random array of individualized fibers substantially undamaged by mechanical action and having a controlled cross-directional profile, and by its freedom from nits, pills, rice and the like, thereby improving both the appearance and the tensile strength of the web. The full-width feeding of dry fibers to a 2-dimensional flow control and fiber screening system is described wherein substantially no cross-flow forces are created in the system, ensuring a uniform cross-directional basis weight profile. The fibers are subjected to only minimal mechanical disintegrating action at all stages of the process subsequent to hammer-milling and, thus, shortening, curling and/or rolling of the fibers to aggregated fiber masses is minimized. The aggregated fiber masses which are present in the fiber stream fed to the system are centrifugally and tangentially separated from individualized fibers and soft fiber flocs and removed from the system while maintaining relatively low fiber separation and/or recycling on the order of less than 10%.

14 Claims, 11 Drawing Figures fig. 4.
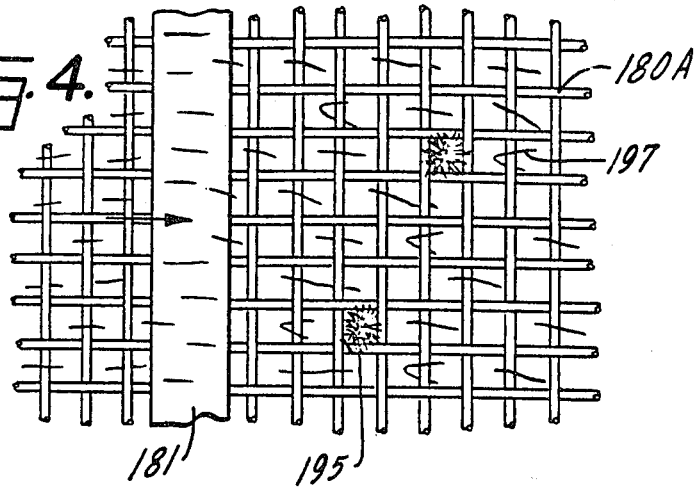
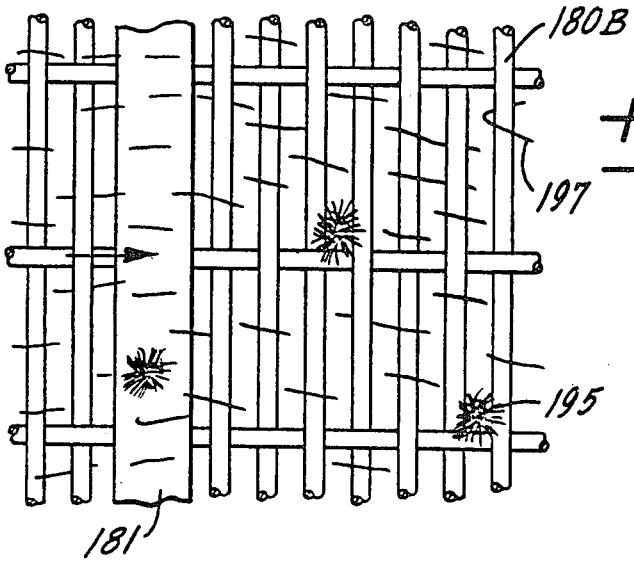
fig. 5.
fig. 7.
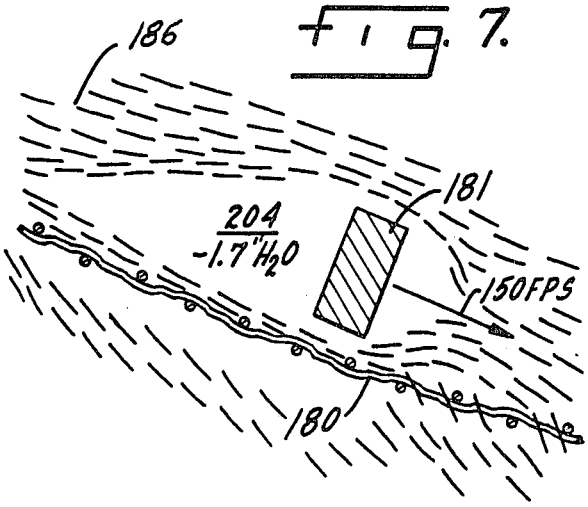

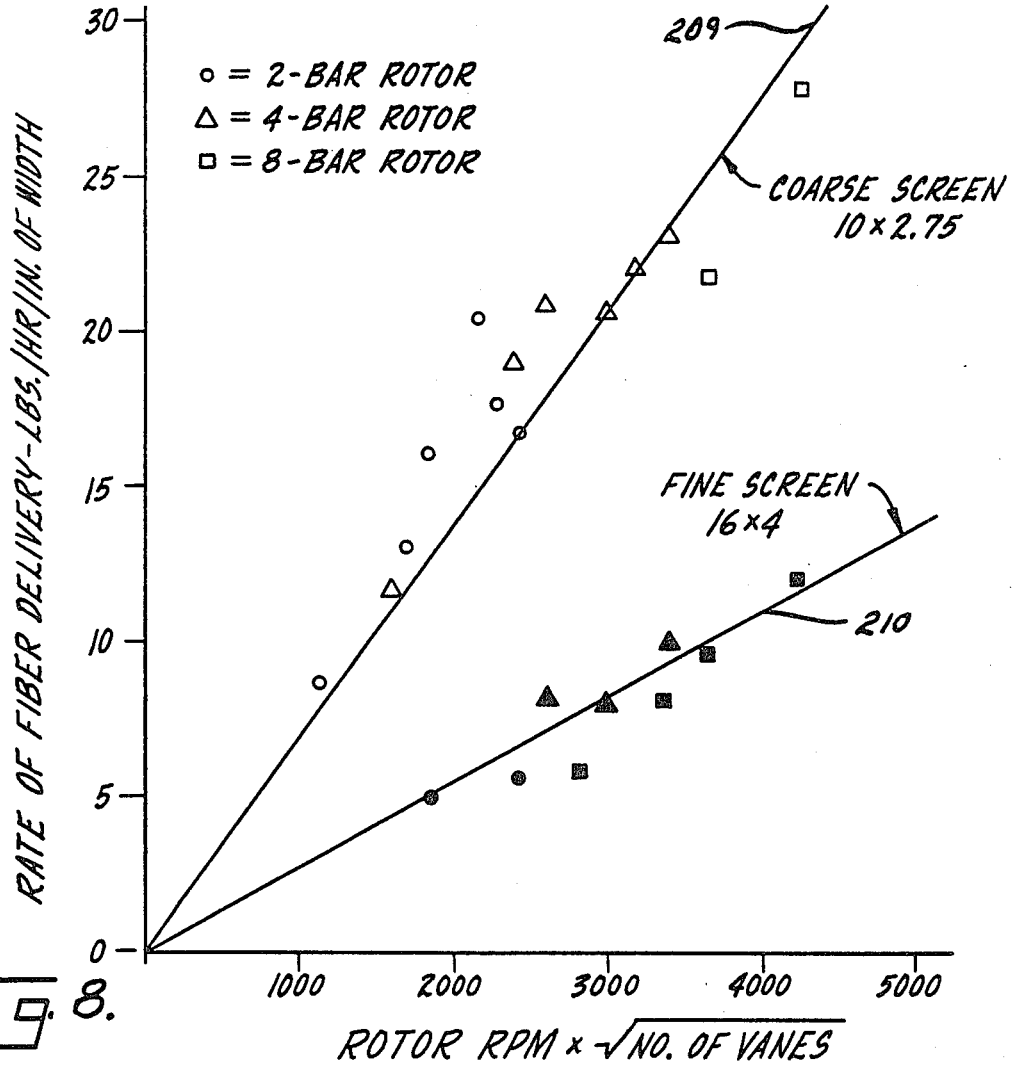
fig. 8.
fig. 9.
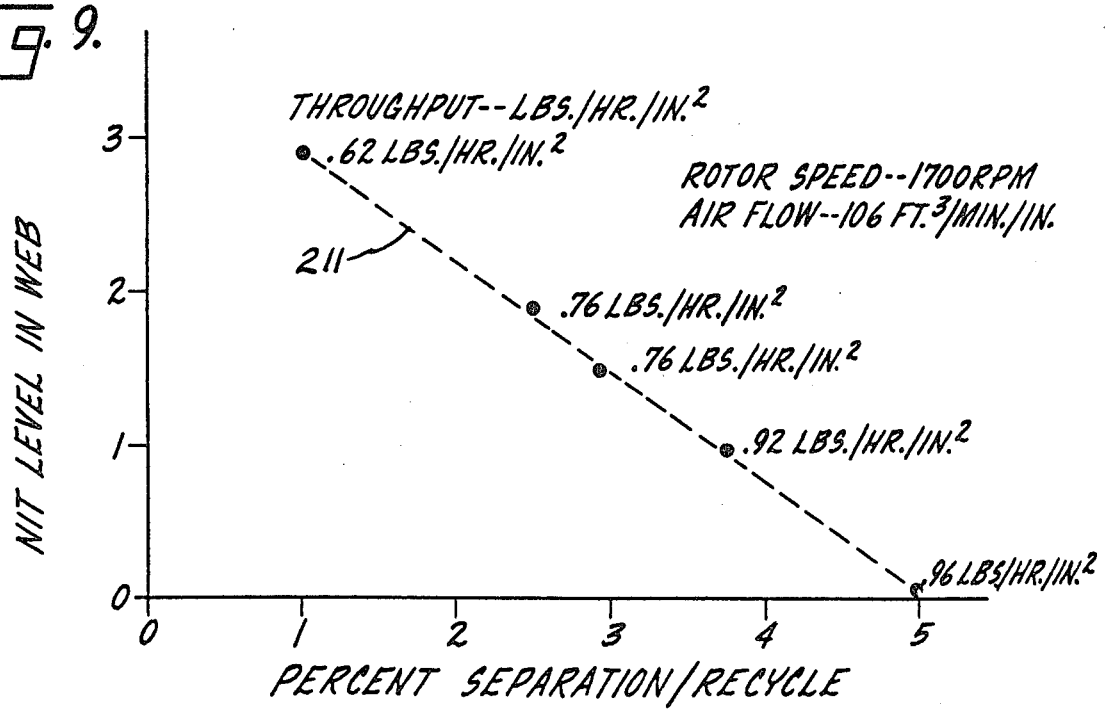

METHOD OF FORMING A WEB OF AIR-LAID DRY FIBERS

RELATED APPLICATIONS

This application is a Continuation-in-part of application Ser. No. 106,144, filed Dec. 21, 1979 now abandoned.

BACKGROUND OF THE INVENTION

The present invention relates in general a method for forming non-woven webs and to the products produced thereby suitable for bath tissue or the like to heavier webs suitable for facial tissues, components for feminine napkins, diaper fillers, toweling, wipes, non-woven fabrics, saturating paper, paper webs, paperboard, et cetera.

Conventionally, materials suitable for use as disposable tissue and towel products have been formed on paper-making equipment by water-laying a wood pulp fibrous sheet. Following formation of the sheet, the water is removed either by thermal drying or by a combination of pressing and drying. As water is removed during formation, overall hydrogen bonding occurs at substantially all fiber intersections, and a thin, essentially planar sheet is formed. It is the hydrogen bonds between fibers which provide sheet strength, but due to this overall bonding phenomenon, cellulosic sheets prepared by water-laid methods inherently possess very unfavorable tactile properties (harshness, stiffness, low bulk, and poor overall softness) and poor absorbency characteristics.

To improve these unfavorable properties, water-laid sheets are typically creped from the dryer roll with a doctor blade. Creping reforms the flat sheet into a corrugated-like structure, thereby increasing its bulk and simultaneously breaking a significant portion of the fiber bonds, thus artificially improving the tactile and absorbency properties of the material. However, conventional creping is most effective on relatively low basis weight webs (less than about 15 lbs./2880 ft.$^2$), and higher basis weight webs, after creping, remain quite stiff and are generally unsatisfactory for uses such as quality facial tissues.

Sanford et al. U.S. Pat. No. 3,301,246 proposes improving the tactile properties of water-laid sheets by thermally predrying a sheet to a fiber consistency substantially in excess of that normally applied to the dryer surface of a paper machine and then imprinting the partially dried sheet with a knuckle pattern of an imprinting fabric. Creping of those areas knuckled to the dryer is still essential in order to realize the maximum advantage of the proposed process; and, for many uses, two plies are still necessary.

As will be apparent from the foregoing discussion, conventional paper-making methods have extreme water requirements which limit the locations where paper-making operations may be carried out. Such operations require removing a large quantity of the water used as the carrier, and the used process water can create an associated water pollution problem. Still further, the essential drying procedures consume tremendous amounts of energy.

Air forming of wood pulp fibrous webs has been carried out for many years; however, the resulting webs have been used for applications where either little strength is required, such as for absorbent products—i.e., pads—or applications where a certain minimum strength is required but the tactile and absorbency properties are unimportant—i.e., various specialty papers. U.S. Pat. No. 2,447,161 to Coghill, U.S. Pat. No. 2,810,940 to Mills, and British Pat. No. 1,088,991 illustrate various air-forming techniques for such applications.

In the late 1940's and early 1950's, work by James D'A. Clark resulted in the issuance of a series of patents directed to systems employing rotor blades mounted within a cylindrical fiber "disintegrating and dispersing chamber" wherein air-suspended fibers were fed to the chamber and discharged from the chamber through a screen onto a forming wire—see, J. D'A. Clark U.S. Pat. Nos. 2,748,429, 2,751,633 and 2,931,076. However, disintegration of the fibers by mechanical co-action of the rotor blades with the chamber wall and/or the screen mounted therein cause fibers to be "rolled and formed into balls or rice which resist separation"—a phenomenon more commonly referred to today as "pilling". These problems and proposed solutions thereto, are described in J. D'A. Clark U.S. Pat. No. 2,827,668, J. D'A. Clark et al. U.S. Pat. Nos. 2,714,749 and 2,720,005; Anderson U.S. Pat. No. 2,738,556; and, Anderson et al. U.S. Pat. No. 2,738,557.

A second type of system for forming air-laid webs of dry cellulosic fibers which has found limited commercial use has been developed by Karl Kristian Kobs Kroyer and his associates as a result of work performed in Denmark. Certain of these systems are described in: Kroyer U.S. Pat. Nos. 3,575,749 and 4,014,635; Rasmussen U.S. Pat. Nos. 3,581,706 and 3,669,778; Rasmussen et al. U.S. Pat. No. 3,769,115; Attwood et al. U.S. Pat. No. 3,976,412; Tapp U.S. Pat. No. 4,060,360; and, Hicklin et al. U.S. Pat. No. 4,074,393. In general, these systems employ a fiber sifting chamber or head having a planar sifting screen which is mounted over a forming wire. Fibers are fed into the sifting chamber where they are mechanically agitated by means of a plurality of mechanically driven rotors mounted for rotation about vertical axes. Each rotor has an array of symmetrical blades which rotate in close proximity to the surface of the sifting screen. The systems described in the aforesaid Kroyer and related patents generally employ two, three, or more side-by-side rotors mounted in suitable forming head.

This type of sifting equipment suffers from poor productivity because the rotor action concentrates most of the incoming material at the periphery of the blades where the velocity is at a maximum. Most of the sifting action is believed to take place in these peripheral zones, while other regions of the sifting screen are either covered with more slowly moving material or are bare, thereby producing a web with a non-uniform basis weight profile. Thus, a large percentage of the sifting screen area is poorly utilized and the system productivity is low. Moreover, fibers and agglomerates tend to remain in the forming head for extended periods of time, especially in the lower velocity, inner regions beneath the rotor blades. This accentuates the tendency of fibers to roll up into pills. Consequently, if the forming head is to be cleared of agglomerated material, it is necessary to remove 10% or more by weight of the incoming material from the forming head for subsequent reprocessing or for use in less critical end products. The separating method used (U.S. Pat. No. 4,014,635) entrains a large number of good fibers with the agglomerates leaving the forming head which are damaged by the hammermills in the secondary processing system.

The inventors have found that, when using high quality fibers in the Kroyer-type system, the above difficulties were aggravated. The rate of pill formation increased and it was necessary to remove and recycle more than 50% by weight of the incoming fibrous material to produce good quality tissue-weight webs. Productivity was unacceptably low and excessive damage was done to otherwise good fibers during the secondary hammermilling step. The tensile strength of the webs produced was decreased, and the circular movement of the rotors above the screen caused corresponding air and fiber movement in the forming region below the screen, resulting in basis weight nonuniformities.

In an effort to overcome the productivity problem, complex production systems have been devised utilizing multiple forming heads—for example, up to eight separate spaced forming heads associated with multiple hammermills and each employing two or three side-by-side rotors. The most recent sifting type systems employing on the order of eighteen, twenty or more rotors per forming head, still require up to three separate forming heads in order to operate at satisfactory production speeds—that is, the systems employ up to fifty-four to sixty, or more, separate rotors with all of the attendant complex drive systems, feed arrangements, recycling equipment and hammermill equipment.

During the 1970's a series of patents were issued to C. E. Dunning and his associates which have been assigned to the assignee of the present invention; such patents describing yet another approach to the formation of air-laid dry fiber webs. See: Dunning U.S. Pat. Nos. 3,692,622, 3,733,234 and 3,764,451; and, Dunning et al. U.S. Pat. Nos. 3,776,807 and 3,825,381. This development has been found to resolve a number of the problems that have heretofore plagued the industry. For example, high productivity rates have been achieved and fiber webs can easily be formed at high machine speeds. However, the system requires preparation of pre-formed rolls of fibers having high cross-directional uniformity and is not suitable for use with bulk or baled fibrous materials. Because of this, problems are experienced when attempting to scale the equipment up to produce wide webs—i.e., webs on the order of 120 inches in width or greater—and the requirement for pre-formed special web rolls having the requisite uniformity in cross-directional profile has been such that, to date, the system has found only limited commercial application.

Indeed, heretofore it has not been believed that air-forming techniques can be advantageously used in high speed production operations to prepare cellulosic sheet material that is sufficiently thin, and yet has adequate strength, together with softness and absorbency, to serve in applications such as bath tissues, facial tissues and light weight toweling.

SUMMARY OF THE INVENTION

In accordance with the present invention, provision is made for forming an air-laid web of dry fibers by: (a) conveying individualized fibers and soft fiber flocs in a high volume air stream through a flow control and screening system wherein provision is made for substantially eliminating cross-flow and eddy current forces as to maintain cross-directional control of the mass quantum of fibers being conveyed and wherein the fibrous materials are subjected to only minimal mechanical action so as to minimize the formation of undesired pills and nits; (b) separating individualized fibers and soft fiber flocs from undesired pulp lumps, pills, rice, nits and other undesired aggregated fiber masses with the individualized fibers and soft fiber flocs beging permitted to pass through a separator screen into a forming zone while the undesired aggregated fiber masses are withdrawn from the air stream for secondary hammermilling operations and/or scrap or usage in inferior products; and, (c) air-laying the dry individualized fibers and soft fiber flocs on a relatively moving forming surface in a largely random pattern while maintaining cross-directional control of the mass quantum of fibers being air-laid across the full-width of the forming zone.

DESCRIPTION OF THE DRAWINGS

Advantages of the present invention will become more readily apparent upon reading the following detailed description and upon reference to the attached drawings, in which:

FIG. 4 is a diagramatic plan view indicating in schematic, idealized fashion fiber movement through a conventional woven square-mesh screen under the influence of air movement and rotor action;

FIG. 5 is a view similar to FIG. 4, but here depicting movement of fibers through a high capacity slotted screen in which the slots are oriented parallel to the axis of the rotor;

FIG. 7 is a highly enlarged view of a portion of the system shown diagrammatically in FIG. 6, FIG. 8 is a graphic representation of relationships existing between fiber throughput for specific representative screen designs and rotor assembly operating parameters;

FIG. 9 is a graphic representation of the functional relationships existing between nit levels, fiber throughput, and recycle percentage in a finished web;

Figure 2:
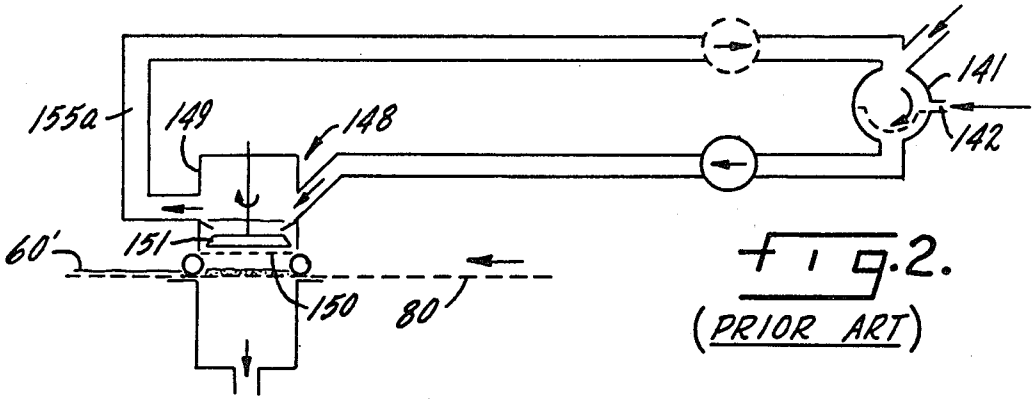
FIG. 2. (PRIOR ART)
FIG. 2 is a schematic side elevational view of a conventional prior art fiber sifting system.

While the invention is susceptible of various modifications and alternative forms, specific embodiments thereof have been shown by way of example in the drawings and will herein be described in detail. It should be understood, however, that it is not intended to limit the invention to the particular forms disclosed, but, on the contrary, the intention is to cover all modifications, equivalents and alternatives falling within the spirit and scope of the invention as expressed in the appended claims.

DETAILED DESCRIPTION

A. Definitions

To facilitate an understanding of the ensuing description and the appended claims, definitions of certain selected terms and phrases as used throughout the specification and claims are set forth below.

The words "nit", "pill" and/or "rice" are herein each used to describe a dense, rolled up bundle of fibers, often including bonded fibers, having a bulk density greater than 0.2 grams per cubic centimeter (g./cc.).

The terms "floc" and "soft floc" are herein used to describe soft, cloud-like accumulations of fibers which behave like individualized fibers in air.

"Bulk density" is the weight in grams of an uncompressed sample divided by its volume in cubic centimeters.

The phrase "2-dimensional" is used to describe a system for forming a web wherein the cross-section of the system and the flows of air and fiber therein are the same at all sections across the width of the system and where each increment of system width behaves essentially the same as every other increment of system width.

The phrase "coefficient of variation" is used herein to describe variations in the cross-directional basis weight profile of both the web being formed and the fibrous materials input to the system, and comprises the standard deviation ($\sigma$) expressed as a percent of the mean. The coefficient of variation should not vary more than 5% and, preferably, should vary less than 3% in the cross-machine direction.

The term "throughput" and the phrase "rate of web formation" are herein used generally interchangeably and are to be distinguished from the phrase "rate of fiber delivery". Thus, the phrase "rate of fiber delivery" is intended to mean the mass quantum or weight rate of feed of fibrous materials delivered to the forming head, expressed in units of pounds per hour per inch of former width (lbs./hr./in.). "Throughput" is intended to described the screening rate for fibrous materials discharged from the forming head through the former screen per unit area of screen surface, expressed in units of pounds per hour per square inch of effective screen surface area (lbs./hr./in.$^2$).

B. Overall System Description

Figure 1:
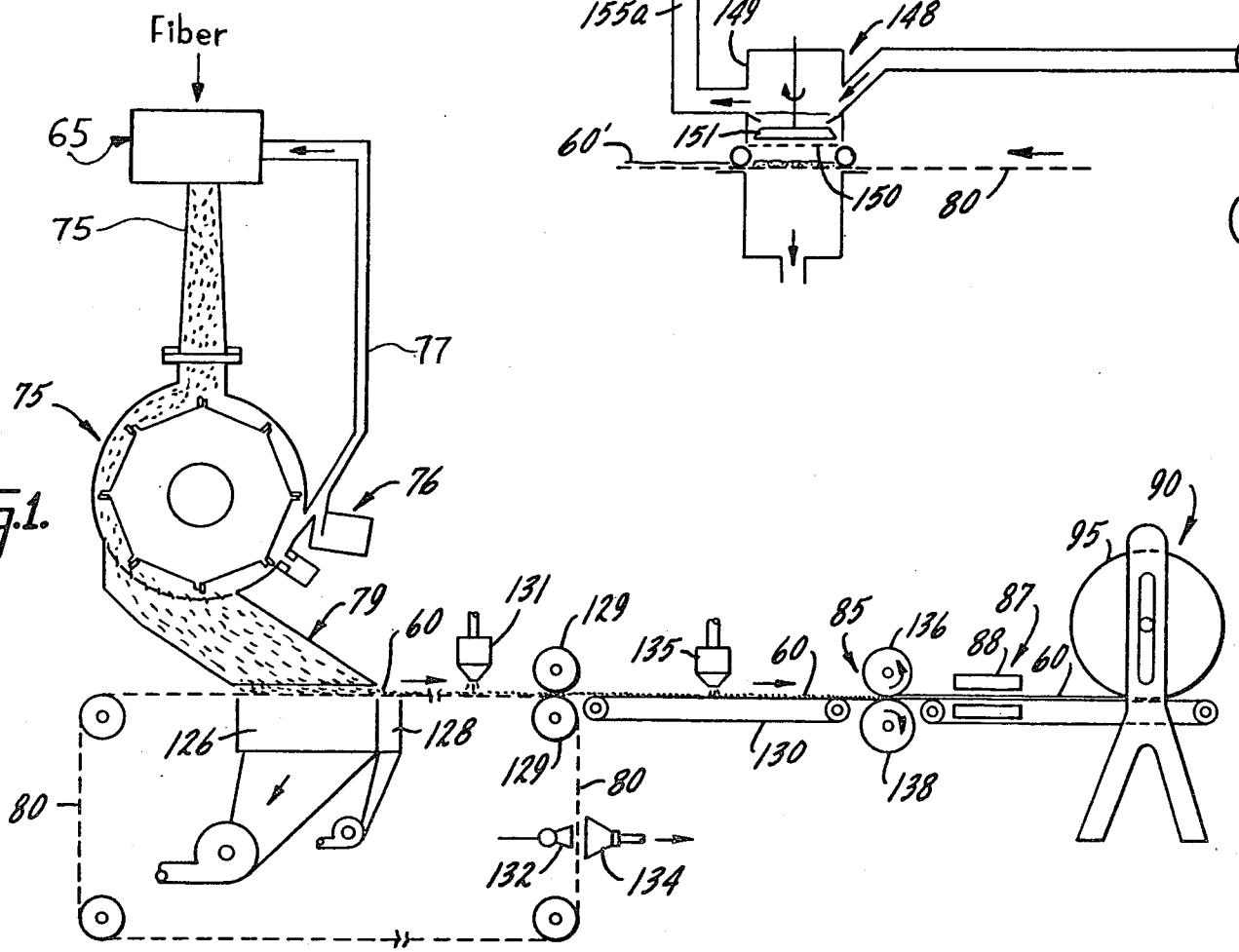
FIG. 1 is a schematic side elevation view of one form of the apparatus of the present invention.

Briefly, and referring first to FIG. 1, there has been illustrated an exemplary system for forming an air-laid web 60 of dry fibers, such system here comprising: a fiber metering section, generally indicated at 65; a fiber transport or educator section, generally indicated at 70; a forming head, generally indicated at 75, where provision is made for controlling air and fiber flow, and where individual fibers are screened from undesirable aggregated fiber masses and, thereafter, are air-laid on a foraminous forming wire 80; a suitable bonding station, generally indicated at 85, where the web is bonded to provide strength and integrity; a drying station, generally indicated at 87, where the bonded web 60 is dried prior to storage; and, a take-up or reel-type storage station, generally indicated at 90, where the air-laid web 60 of dry fibers is, after bonding and drying, formed into suitable rolls 95 for storage prior to delivery to some subsequent processsing operation (not shown) where the web 60 can be formed into specifically desired consumer products.

In keeping with the present invention, the forming head 75 includes a separator system, generally indicated at 76, for continuous removal of aggregated fiber masses. Such separated aggregated fiber masses and individualized fibers entrained therewith are preferably removed from the forming area by means of a suitable conduit 77 maintained at a pressure level lower than the pressure within the forming head 75 by means of a suction fan (not shown). The conduit 77 may convey the masses to some other area (not shown) for use in inferior products, for scrap, or, alternatively, the undesirable aggregated fiber masses may be recycled to a hammermill where the masses are subjected to secondary mechanical disintegration prior to reintroduction into fiber meter 65. Finally, the forming head 75 also includes a forming chamber, generally indicated at 79, positioned immediately above the foraminous forming wire 80. Thus, the arrangement is such that individual fibers and soft fiber flocs pass through the forming chamber 79 and are deposited or air-laid on the forming wire 80 to form a web 60 characterized by its controlled cross-directional profile and basis weight.

C. Fiber Metering Section

While various types of commercially available fiber metering systems 65 can, with suitable modifications, be employed with equipment embodying the features of the present invention, one system which has been found suitable and which permits of the necessary modifying adaptations in a RANDO-FEEDER® (a registered trademark of the manufacturer, Rando Machine Corporation, Macedon, New York).

It is essential to the proper operation of the present invention that a uniform density fiber mass is conveyed to the forming head 75 in the air stream in eductor 70. The Rando-Feeder® has been found to provide a sufficiently uniform fiber stream to produce quality webs in the present apparatus.

D. Web Forming, Compacting, Bonding, Drying & Storage Section

A vacuum box 126 positioned immediately below the forming wire 80 and the web forming section 79 serves to maintain a positive downwardly moving stream of air which assists in collecting the web 60 on the moving wire 80. If desired, a second supplementary vacuum box 128 may be provided beneath the forming wire at the point where the web 60 exits from beneath the forming chamber 79, thereby insuring that the web is maintained flat against the forming wire.

After formation, the web 60 is passed through calendar rolls 129 to lightly compact the web and give it sufficient integrity to permit ease of transportation to conveyor belt 130. A light water spray can be applied from nozzles 131 and 135 in order to counteract static attraction between the web and the wire. An air shower 132 and vacuum box 134 serve to clean loose fibers from the wire 80 and thus prevent fiber build-up.

After transfer to the belt 130, the web 60 may be bonded in any known conventional manner, such as (i) spraying with adhesives such as latex, (ii) overall calendering to make a saturating base paper, (iii) adhesive print pattern bonding, or other suitable process. Such bonding processes do not form part of the present invention and, therefore, are neither shown nor described in detail herein, but, such processes are well known to those skilled in the art of non-woven fabric manufacture. Bonding of the web as by rolls 136 and 138, and drying at 87, may be necessary prior to forming the roll 95.

Multiple forming heads 75 may be provided in series in order to increase overall productivity of the system.

Each forming head may be operated at an increased speed, reducing the throughput of each head, but with multiple heads laying successive layers of fibers on one another, productivity may be significantly increased.

E. Prior Art Sifting Systems

Referring next to FIG. 2, there has been illustrated a conventional sifting system of the type described in the aforesaid Kroyer U.S. Pat. No. 4,014,635 for forming air-laid webs of dry fibers. As here shown, a hammermill 141 disintegrates fiber provided through conduit 142, the fiber being thereafter conveyed to distributor 148 for distribution onto moving forming wire 80 through screen 150. A plurality of rotating impellers 151 rotate about vertical axes and "sift" the fiber through screen 150. Material to be recycled is removed through conduit 155*a* to the hammermill 141.

In operation, pulp or other fibrous material is subjected to intensive mechanical disintegration in hammermill 141, and the resulting individualized fibers, pills and pulp lumps are then fed into the fiber distributor 148 where they are subjected to severe mechanical agitation by impellers 151. Such mechanical agitation results in stratification of the fibrous materials, with the finer materials said to move downwardly, and the coarser materials rising upwardly where such coarse materials are recycled to hammermill 141 for secondary hammermilling operations. The finer materials include individual fibers, soft fiber flocs and relatively small nits which are mechanically propelled across the surface of and through the perforate bottom wall or screen 150 by the agitating and sifting action provided by the impellers 151. That material passing through the perforate bottom wall or mesh screen 150 is then deposited on the forming wire 80 by means of gravity and the air stream generated by suction box 126 to form an air-laid web 60' of dry fibers.

The foregoing sifting system has proven suitable for forming relatively high basis weight webs—e.g., webs having basis weights on the order of 24 lbs./2880 ft.$^2$ or greater. However, it has been found that extremely high fiber recycle percentages must be maintained when attempting to form webs, particularly when attemping to form relatively light basis weight webs suitable for bath and/or facial tissues. As a result, productivity of the fiber distributor is extremely low, and a large percentage of the input fibers are subjected to secondary hammermilling operations which tend to further shorten, curl and otherwise damage the fibers and which require excessive amounts of energy consumption. And, of course, the rotary sifting action of the impellers 151 tends to roll fibers between the impeller blades and the housing 149 and the screen 150 thus generating a large number of undesired pills which increase the recycle percentage.

In order to increase the productivity of this system, to acceptable levels a number of distributor heads have been mounted in series over a single forming wire. In this manner each distributor lays a very thin layer of fibers on the layer from the preceeding distributor. However, such systems are limited in width and generally have poor cross-directional profiles, poor formation, and low strength due to mechanical damage to the fibers.

AIR-LAID DRY FIBER WEB FORMATION IN ACCORDANCE WITH THE PRESENT INVENTION

The present invention is concerned with improvements in the Kroyer and D'A. Clark types of systems, such that the flow control and screening arrangement is of the 2-dimensional type employing an elongate rotor housing having a single rotor mounted for rotation about a horizontal axis located above the forming wire 80. Since the process of the present invention is essentially 2-dimensional with no component of flow in the cross-machine direction, it is significantly more manageable and predictable than a sifting type former employing multiple rotors rotating in a horizontal plane about vertical axes, thereby permitting the system to be conveniently and readily scaled up and/or down in width to meet commercial web requirements.

F. Full-Width Metered Fiber Feed

Figure 3:
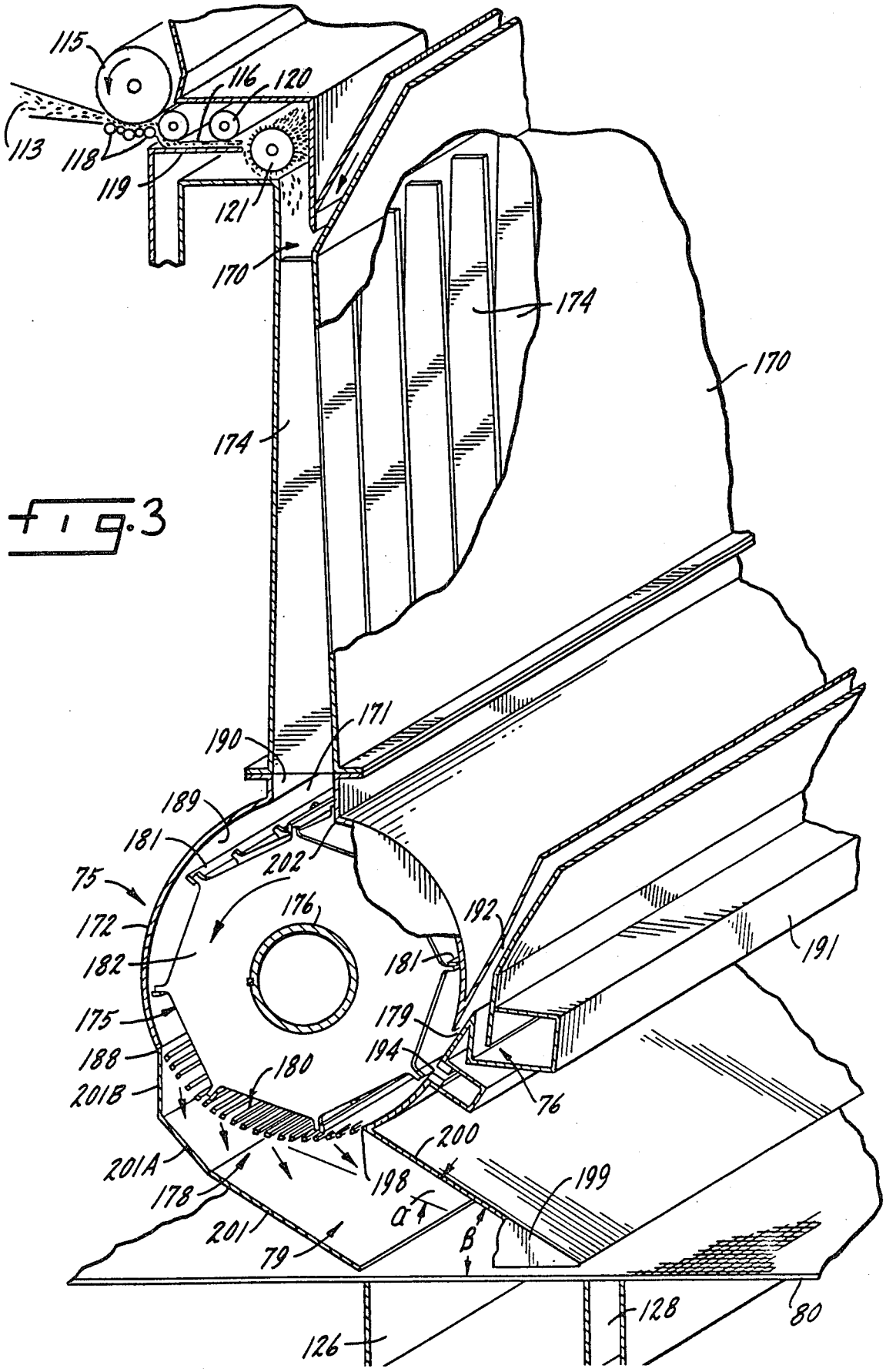
FIG. 3 is an oblique view, partially cut away, here schematically illustrating details of an exemplary novel fiber feed, educator, flow control, screening, and fiber forming arrangement embodying feature of the present invention.

In order for the present invention to function properly, it is necessary to provide uniform full-width feed of fibers having a controlled cross-directional profile in terms of the mass quantum of fibers. To this end, and as best illustrated in FIG. 3, feed mat 116 may be formed which meets the preferred conditions of full-width uniformity in terms of the mass quantum of fibers forming the mat and the coefficient of variation of the fibrous materials input to the system. The mat thus formed is then fed into the teeth of lickerin 121 which serves to disaggregate the fibers defining the mat by combing such fibers (along with any pulp lumps, nits and other aggregated fiber masses which are present) out of the mat and feeding such materials directly into a high volume air stream 123.

In operation, the air-suspended fiber stream is conveyed through a suitable fiber transport duct 170 (FIG. 3) from the full-width eductor 70 to a full-width inlet slot 171 formed in the upper surface of, and extending fully across, a generally cylindrical housing 172 which here defines the 2-dimensional flow control, screening and separating zone 75. To insure that full-width mass quantum fiber control is maintained, the exemplary duct 170 is preferably subdivided into a plurality of side-by-side flow channels separated by partitions 174 extending the full length of the duct. It has been found that the desired coefficient of variation constraint in the web being formed can be obtained by spacing the partitions 174 apart by approximately four inches so as to form a plurality of adjacent flow channels extending across the full axial length of housing 172. It has also been found that a partitioned duct arrangement of the type shown in FIG. 3 can be advantageously used to accommodate width differences between the feed mat 116 formed in the fiber metering section 65 and the final air-laid web 60 deposited on the foraminous forming wire 80. For example, excellent results have been obtained when forming a web 60 forty-eight inches in width, utilizing a feed mat 116 only forty inches in width.

G. Flow Control, Screening and Separation In carrying out the invention, air-suspended fibrous materials introduced radially into housing 172 through inlet slot 171 are conveyed by co-action of the air stream and the rotor assembly 175 through the housing 172 for controlled and selective discharge either (a) through a full-width discharge opening, generally, indicated at 178 in FIG. 3, and into forming zone 79 for ultimate, air-laid deposition on forming wire 80 or, alternatively, (b) through a full-width tangential separator slot 179 formed in housing 172 downstream of the discharge opening 178. The separator slot 179, which here forms part of the separation and/or recycle zone 76 (FIGS 1 and 3), is preferably on the order of from 3/16" to ⅜" in circumferential width when working with wood fibers and, if desired, may be adjustable in any conventional manner (not shown) so as to permit circumferential widening or narrowing of the slot 179 to optimize separation conditions.

To permit controlled, selective discharge of individualized fibers and soft fiber flocs through opening 178 and into forming zone 79, while at the same time precluding discharge of nits and other undesired aggregated fiber masses therethrough, suitable screening means, generally indicated at 180 in FIG. 3, is mounted within discharge opening 178. Such screening means 180 may simply take the form of a conventional woven square-mesh wire screen of the type shown at 180A in FIG. 4 and having openings sized to preclude passage of aggregated fiber masses provided that the screen openings do not exceed 0.1" open space from wire-to-wire in at least one direction and have been between 38% and 46% open area. As best shown in FIG. 3, screening means 180 is formed with the same radius of curvature as the semi-cylindrical portion of housing 172 within which discharge opening 178 is formed.

In carrying out this aspect of the invention, rotor assembly 175 comprises a plurality of transversely extending rotor bars 181, each fixedly mounted on the outer periphery of a plurality of closely spaced spiders 182. The bars 181 move through the radially entering stream of air-suspended fibers entering at inlet slot 171. As a result of rotor bar movement and the high velocity movement of the air stream, the air and fibers tend to move outwardly towards the wall of housing 172, thus best illustrated at 186 in FIG. 6. Such annular aerated bed 186 of fibrous materials is believed to be on the order of one-half inch to one and one-half inches thick (dependent upon actual operating parameters), and is believed to be moving rotationally at about half the speed of the rotor bars 181. The rotor assembly 175 is preferably designed (a) to minimize pumping action which tends to reduce the relative speed differential between the rotor bars 181 and the aerated bed 186, thus causing the fibers to move over and beyond the screening means 180, and (b) so as to minimize mechanical action between the rotor bars 181 and both the housing 172 and screening means 180, which action tends to disintegrate fibers and aggregated fiber masses carried in the air stream and to general pills. The rotor bars 181 are on the order of ¾" in radial height by ⅜" in thickness, and are mounted so as to provide a clearance between the outer edges of the bars 181 and the inner wall surface of the housing 172 and screening means 180 of from 0.10 inches to 0.25 inches and, preferably, from 0.18 inches to 0.20 inches. To avoid generation of cross-flow forces, it is important that the rotor bars 181 are continuous, extend the full width of the rotor chamber, and are oriented parallel to the axis of the rotor assembly 175.

As the aerated bed—which contains individualized fibers, soft fiber flocs, nits and other aggregated fiber masses—passes over the screening means 180, some, but not all, of the individualized fibers and soft fiber flocs pass through the screening means into the forming zone 79, while the balance of the individualized fibers and soft fiber flocs, together with nits and other aggregated fiber masses, pass over the screen without exiting from the rotor housing 172. The undesired pills, rice and nits (aggregated fiber masses) have a bulk density generally in excess of 0.2 g./cc. and tend to be separated along with some individualized fibers and soft fiber flocs from the aerated bed 186 at the tangential separator slot 179, with those separated materials being centrifugally expelled through the slot 179 where they are entrained in a recycle or separating air stream generated by any suitable means (not shown) coupled to manifold 191. The air-suspended separated particles move outward through a full-width discharge passage 192 coupled to separator slot 179 and, ultimately, to conduit 77 (FIG. 1). Such separation is aided by a positive air outflow from housing 172 through separator slot 179.

Separation of undesired nits and aggregated fiber masses from individualized fibers and soft fiber flocs is accomplished with a full-width classifying air jet 194, provided upstream of the separator slot 179 and downstream of screening means 180; such air jet being positioned to introduce a full-width air stream generated by any conventional source (not shown) radially into rotor housing 172 just ahead of the separator slot 179. As a consequence, the positive classifying air stream introduced radially into housing 172 through air jet 194 tends to divert individualized fibers and soft fiber flocs within the aerated bed 186 radially inward as a result of the relatively high drag coefficients of such materials and their relatively low bulk density (which is generally on the order of less than 0.2 g./cc.). Since the nits and aggregated fiber masses have a relatively high bulk density in excess of 0.2 g./cc. and relatively low drag coefficients, the classifying air stream introduced through the full-width air jet 194 does not divert such materials to any significant extent and, therefore, such undesired materials tend to be cetrifugally expelled through the tangential separator slot 179. It has been found that the introduction of classifying air through the full-width classifying air jet 194 into housing 172 at pressures on the order of from 30" to 100" $H_2O$ and at volumes ranging from 1.5 to 2.5 $ft.^3$/min./in. is adequate for deflecting a significant portion of the individualized fibers and soft fiber flocs. The energy level of the classifying air jet is most conveniently controlled by adjusting its pressure.

In operation, it has been found that excellent results are obtained if at least 90% of the fibrous material introduced and, preferably between 95% and 99% thereof, ultimately pass through screening means 180 into the forming zone 79 and are air-laid on the foraminous forming wire 80 without requiring any secondary hammermilling operations and without being subjected to any significant mechanical disintegrating forces. The quantity of material separated may be controlled by the operator by varying the volume of recycle air supplied through manifold 191 and/or by adjusting the circumferential extent of full-width separator slot 179 in any suitable manner (not shown).

Although the present invention has thus far been described in connection with the use of a conventional woven square-mesh screen 180A (FIG. 4) for the screening means 180 shown diagrammatically in FIG. 3, it is preferred that the screening means 180 take the form of a high capacity slotted screen 180B—e.g., of the type shown in FIG. 5. When utilizing a slotted type screen 180B with a 2-dimensional rotor assembly 175 mounted for rotation about a horizontal axis, it has been found essential that the screen slots be oriented with their long dimensions parallel to the axis of the rotor assembly. When so oriented, individualized fibers tend to move through the screen slots while nits and aggregated fiber masses 195 are precluded from passing through the screen since they are generally larger in size than the narrow dimensions of the slots which, preferably, do not exceed 0.1" open space from wire-to-wire in at least one direction. However, when the slots of a slotted screen 180B are oriented with their long dimensions perpendicular to a plane passing through the rotor axis, it has been found that the screen tends to rapidly plug—indeed, when operating under commercial production conditions, it has been found that the screen tends to become completely plugged almost instantaneously.

The rotor bars 181 need not be rectangular in cross-section. Rather, they can be circular, vane-shaped, or of virtually any other desired cross-sectional configuration not inconsistent with the objective of minimizing rotor pumping action. The number of rotor bars may be anything over 2 so long as the assembly 175 is dynamically balanced.

It is significant to a complete understanding of the present invention that one understand the difference between the primary function of the rotor assembly here provided—to lift fibrous materials upwardly and off the screen—and that stated for conventional cylindrical rotor systems of the type disclosed in the aforesaid J. D'A. Clark patents where the rotor chamber functions as a "disintegrating and dispersing chamber" (See, e.g., col. 4, line 53, J. D'A. Clark U.S. Pat. No. 2,931,076), where the rotor blades mechanically act upon the fibrous materials to "disintegrate" such materials and propel them through the screen.

H. Forming Zone

In keeping with another important aspect of the present invention, provision is made for insuring the individualized fibers passing through the screening means 180 are permitted to move directly to the foraminous forming wire 80 without being subjected to cross-flow forces, eddy currents or the like, thereby maintaining cross-directional control of the mass quantum of fibers delivered to the forming wire through the full-width of forming zone 79. To accomplish this, the boundaries of the forming zone 79 are formed so as to define an enclosed forming zone and to thereby preclude intermixing of ambient air with the air/fiber stream existing housing 172 through screening means 180. It has been found that the air/fiber stream exiting from housing 172 through screening means 180 does not exit radially but, rather, at an acute angle or along chordal lines or vectors which, on average, tend to intersect a line tangent to the mid-point of the screening means 180 at an included angle $\alpha$. In the exemplary form of the invention where the screening means 180 covers an arc of approximately 86° and, where an 8-bar rotor is being operated at a rotor speed on the order of 1400–1450 RPM, it has been found that the angle $\alpha$ is generally on the order of 11°.

Consequently, the forming zone 79 is preferably provided with sidewalls (a portion of one such sidewall is shown at 199 in FIG. 3), a full-width downstream forming wall 200, and a generally parallel full-width upstream forming wall 201, which are respectively connected to rotor housing 172 at the downstream and upstream edges of screening means 180, and which respectively lie in parallel planes which intersect a line tangent to the mid-point of the screening means 180 at included angles on the order of 11°. The upstream end of forming wall 201 is bent as indicated at 201A, 201B so as to form a shaped portion which generally accommodates the air/fiber flow pattern exiting the upstream portion of screening means 180. The walls 199, 200 and 201 serve to enclose the forming zone 79 and to thereby preclude disruption of the air/fiber stream as a result of mixing between ambient air and the air/fiber stream. The enclosed forming zone 79 is preferably maintained at or near atmospheric pressure so as to prevent inrush and outrush of air and to thereby assist in precluding generation of cross-flow forces within the forming zone. Those skilled in the art will appreciate that angle $\alpha$ can vary with changes in operating parameters, such as changes in rotor RPM. However, for operation at or near optimum conditions, it is believed that the angle $\alpha$ will generally lie within the range of 5° to 20° and, preferably, will lie within the range of 8° to 15°. The lower edges of forming walls 200, 201 terminate slightly above the surface of foraminous forming wire 80—generally terminating on the order of from one-quarter inch to one and one-quarter inches above the wire.

Figure 6:
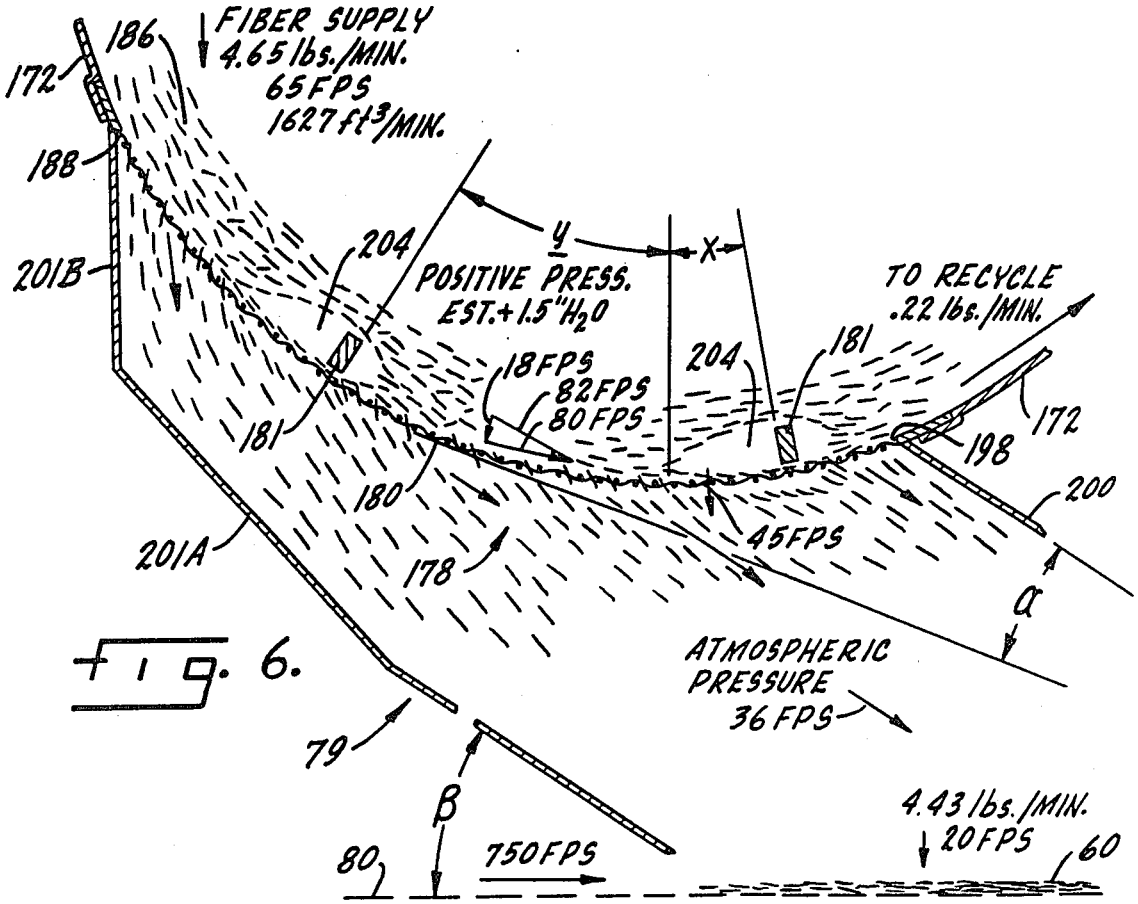
FIG. 6 is an enlarged, fragmentary side elevational view here depicting an annular moving aerated bed of fibers as it moves through the screening means and forming zone.

In the exemplary form of the invention shown in FIG. 6, when the angle $\alpha$ is on the order of 11° and when the forming zone 79 is positioned over a horizontal forming surface 80, the upstream and downstream forming walls lie in planes which intersect the horizontally disposed forming surface 80 at included acute angles $\beta$ where $\beta$ is on the order of 33°. However, those skilled in the art will appreciate that the angular value of $\beta$ is not critical and can vary over a wide range dependant only upon the orientation of the forming surface 80 relative to the forming zone 79.

Since constraining walls 200, 201 are parallel, there is no tendency to decelerate the flow (as would be the case where the walls diverge). This fact aids in preventing eddy currents and other unwanted cross-flow forces. There is, of course, some deceleration of the air/fiber stream as it exits the housing 172 through screening means 180 but, such deceleration occurs immediately upon exit from the screening means and produces only a fine scale turbulence effect which does not induce gross eddy currents or cross-flow forces. In some cases it might be desirable to have the walls 200, 201 converge slightly so as to accelerate, and therefore stabilize, the flow.

The forming zone is preferably dimensioned so that under normal adjustment of variable system operating parameters, the velocity of the fiber/air stream through the forming zone is at least 20 f.p.s. and the fibers are capable of traversing the entire length of the forming zone 79 from screen 180 to forming wire 80 in not more than 0.1 seconds.

I. Overall System Operation

Numerous system parameters may be varied in the operation of a forming system embodying the features of the present invention in order to form an air-laid web of dry fibers having specific desired characteristics. Let it be assumed that the operator wishes to form an air-laid web 60 one foot (1') in width (all ensuing assumptions are per one foot of width of the forming head 75) having a controlled uniform cross-directional profile and a basis weight of 17 lbs./2880 ft.$^2$. Assume further:

(a) Air-to-fiber ratio supplied through inlet slot 171 equals 350 ft.$^3$ of air per pound of fiber.

(b) Inlet slot 171 is 5" in circumferential width—i.e., the dimension from edge 190 (FIG. 3) to edge 202.

(c) Rotor housing 172 is 24" I.D.

(d) Rotor assembly 175 employs eight equally spaced rectangular rotor bars 181, each ¾" in radial height by ⅜" in circumferential thickness and extending parallel to the axis of the rotor assembly continuously throughout the full width of rotor housing 172 and, each spaced from the rotor housing 172 by 0.18".

(e) Rotor assembly 175 is driven at 1432 RPM.

(f) Rotor bar 181 tip velocity equals 150 f.p.s.

(g) Relative velocity between the rotor bars 181 and the aerated bed 186 is approximately 70 f.p.s.

(h) Screening means 180 defines an arc of 86°, and has 40% open area.

(i) Separation and/or recycle through separator slot 179 comprises 5% by weight of fibrous materials supplied through inlet slot 171.

(j) The quantity of classifying air introduced through air jet 194 is between 1.5 and 2.5 ft.$^3$/min./in. at pressures between 30" and 100" $H_2O$.

(k) Forming walls 200, 201 are parallel and spaced 9" apart in a direction normal to the parallel walls 200, 201 and 16" apart in a horizontal plane passing through their lower extremities just above the plane of the forming wire 80.

(l) Forming wire speed equals 750 f.p.m.

All of the foregoing operating parameters are either fixed and known, or can be pre-set by the operator, except for the relative velocity between the rotor bars 181 and the aerated bed 186 of fibers within the rotor housing 172. The actual speed of the aerated bed 186 is not known with certainty; but, it is believed to be on the order of half the tip velocity of the rotor bars 181. For convenience, it is here assumed to be approximately 80 f.p.s., an assumption believed to be reasonably accurate based upon observation of overall system behavior, thereby resulting in a relative velocity between the rotor bars 181 and the aerated bed 186 of approximately 70 f.p.s. (see assumption "g", Supra).

Accordingly, supply and velocity relationships within the foregoing exemplary system can be readily calculated as follows; and, such relationships have been illustrated in FIG. 6:

| | | | |
|---|---|---|---|
| $\frac{17}{2880} \times 750$ | = | 4.43 lbs./min.—Rate of formation of web 60. | [I] |
| $4.43 \times 1.05$ | = | 4.65 lbs./min.—Rate of fiber supply through inlet slot 171. | [II] |
| $4.65 \times 350$ | = | 1627 ft.$^3$/min.—Vol. of air supplied through inlet slot 171. | [III] |
| $2\pi \times \frac{86°}{360°}$ | = | 1.5 ft.—Screen circumference. | [IV] |
| $1.5' \times 1' \times 144$ in.$^2$/ft.$^2$ | = | 216 in.$^2$—Screen area. | [V] |
| $\frac{4.43 \times 60 \text{ min.}}{216 \text{ in.}^2}$ | = | 1.23 lbs./hr./in.$^2$—Fiber throughput of former screen 180. | [VI] |
| 1.5 ft.$^2 \times 40\%$ | = | 0.6 ft.$^2$—Amount of open area in screen 180. | [VII] |
| $\frac{1627}{5/12 \times 60}$ | = | 65 f.p.s.—Velocity of air and fiber stream entering rotor housing 172 through inlet slot 171. | [VIII] |
| $\frac{1627}{1.5 \times 60}$ | = | 18 f.p.s.—Velocity approaching the screen 180 (i.e., normal to the screen). | [IX] |

-continued

| | | | |
|---|---|---|---|
| $\frac{1627}{0.6 \times 60}$ | = | 45 f.p.s.—Velocity through screen openings. | [X] |
| $\frac{1627}{9/12 \times 60}$ | = | 36 f.p.s.—Velocity in forming zone 79. | [XI] |
| $\frac{1627}{16/12 \times 60}$ | = | 20 f.p.s.—Velocity normal to forming wire 80. | [XII] |
| $150 - 70$ | = | 80 f.p.s.—Velocity vector | [XIII] |
| $\sqrt{80^2 + 18^2}$ | = | 82 f.p.s.—Air velocity vector composite within housing 172. | [XIV] |
| $4.65 - 4.43$ | = | .22 lbs./min.—Amount of fiber removed through separator slot 179. | [XV] |

Keeping the foregoing supply and velocity relationships in mind, it will be appreciated that the individualized fibers, soft fiber flocs, and any aggregated fiber masses present in the feed mat 116 (FIG. 3) will be disaggregated and dispersed within the air stream passing through fiber transport duct 170 with essentially the same cross-directional mass quantum relationship as they occupied in feed mat 116. Under the assumed conditions, the air/fiber stream enters rotor housing 172 (FIG. 3) at approximately 65 f.p.s. [Eq. VIII] and at a fiber feed rate of 4.65 lbs./min. [Eq. II]. The volume of air supplied to rotor housing 172 (1,627 ft.$^3$/min. [Eq. III]) is such that a positive pressure of approximately 1.5" $H_2O$ is maintained within the housing 172. Since the forming zone 79 is maintained at atmospheric pressure, there exists a pressure drop on the order of 1.5" $H_2O$ across the screening means 180 through which the air-suspended fibers pass.

Although the air/fiber stream entering rotor housing 172 through inlet slot 171 is moving radially initially, rotation of the rotor assembly 175 (counterclockwise as viewed in FIGS. 3 and 6) tends to divert the fibers outwardly towards the periphery of housing 172 so as to form an annular aerated bed of fibers 186. Movement of the rotor bars 181 through the annular aerated bed 186 of fibers at a rotor bar tip velocity of 150 f.p.s. tends to accelerate the air-fiber stream from its entry velocity of 65 f.p.s. [Eq. VIII] to approximately 80 f.p.s., thus resulting in a relative velocity of 70 f.p.s. between the rotor bars 181 and the aerated bed 186 of fibers. However, because of the clearance of 0.18" between the rotor bars 181 and housing 172, and the relatively small effective area of the rotor bars, only minimal pumping action occurs and there is little or no tendency to roll fibers between the rotor bars 181 and either housing 172 or screening means 180. Therefore, there is little or no tendency to form pills; and, since only minimal mechanical disintegrating action occurs, curling or shortening of individualized fibers is essentially precluded. Rather, the rotor bars 181 sweep through the aerated bed 186 and across screening means 180, thus causing at least certain of the individualized fibers and soft fiber flocs within the aerated bed 186 to move through the screening means—such air-suspended fibers have a velocity vector normal to the screening means 180 of approximately 18 f.p.s. [Eq. IX] and a composite velocity vector of approximately 82 f.p.s. [Eq. XIV] directed towards screening means 180 at an acute angle—while, at the same time, sweeping nits and aggregated fiber masses over and beyond the screening means 180.

Since the rotor bars 181 are moving through the aerated bed 186 of fibers at a relative speed 70 f.p.s. faster than movement of the aerated bed, a negative suction zone of 1.7" $H_2O$ is generated in the wake of each rotor bar 181, as best illustrated at 204 in FIG. 6. Each such negative suction zone extends the full-width of the rotor housing 172 and is parallel to the axis of the rotor assembly 175. In the case of rotor bars having a circular cross-section (not shown), the negative suction generated would be on the order of 3.0" $H_2O$. In either case, the negative suction generated is sufficient to momentarily overcome the pressure drop of approximately 1.5" $H_2O$ across the screening means 180 and, as a consequence, normal flow of the air/fiber stream through screening means 180 ceases momentarily in the region of the screen beneath the negative suction zone 204. The full-width negative suction zones 204 are, of course, also sweeping across the screening means 180 at the same velocity as the rotor bars 181 (150 f.p.s.) and, as a consequence, the rapidly moving spaced full-width lifting forces serve two important functions the generated lifting forces (i) tend to lift individualized fibers and soft fiber flocs off screening means 180 in the wakes of the rotor bars across the full-width of rotor housing 172, thus preventing layering of fibers on the screen which tends to plug the screen openings and thus inhibits free movement of fibers through the screen; and ii, tend to lift nits and other aggregated fiber masses off the screening means 180 so as to facilitate their peripheral movement over and beyond the screening means and towards the full-width separator slot 1979. Such peripheral movement results from the movement of the annular aerated bed 186 and the sweeping action of the rotor bars 181.

Those individualized fibers, soft fiber flocs, and aggregated fiber masses within the aerated bed 186 of fibers which do not pass through the screening means 180 the first time they are presented thereabove are swept over and beyond the screening means 180 and, thereafter, past classifying air jet 194 (FIG. 3). Under the assumed conditions, the individualized fibers and soft fiber flocs tend to be diverted radially inward by the classifying air jet 194, while the undesired aggregated fiber masses are centrifugally and tangentially separated from the aerated bed 186 through full-width separator slot 179 at the rate of 0.22 lbs./min. [Eq. XV]. Those individualized fibers and soft fiber flocs remaining in the aerated bed 186 after transit of separator slot 179 are then returned to the region overlying screening means 180, where they are successively acted upon by the rapid succession of pressure reversal conditions from full-width negative pressure zones 204 alternating with full-width zones of positive pressure drops until all such materials pass through the screening means 180 into forming zone 79.

The air/fiber stream exiting from housing 172 decelerates almost immediately to approximately 36 f.p.s. [Eq. XI] within forming zone 79 and moves through the forming zone toward the foraminous forming wire 80 which is here moving at 750 ft./min. The fibers are air-laid or deposited on forming wire 80 at the rate of 4.43 lbs./min. [Eq. I]—the difference between the rate of fiber supplied [Eq. II] and the 5% of fibrous materials supplied which are separated and removed through separating slot 179—to form web 60. The fibers deposited on the forming wire 80 are held firmly in position thereon as a result of suction box 126 and its associated suction fan and ducting which serve to accommodate and remove the high volume of air supplied.

The web 60 deposited on forming wire 80 has more than adequate integrity to permit rapid movement of the forming wire. Indeed, if one desires to further increase productivity, n additional forming heads may be utilized and the speed of foraminous forming wire 80 may be increased by a factor equal to the number of separate forming heads used—e.g., under the assumed operating condition, two heads would permit operation at 1,500 f.p.m.; three heads would permit operation at 2,250 f.p.m.; etc. Moreover, as a result of the relatively high throughput capacity of each forming head 75, the mass quantum of fibers deposited on the forming wire 80 per unit area of former screen 180 will be on the order of ten times as great as that deposited by conventional prior art sifting heads of the type shown in FIG. 2; and, consequently, the forming wire may be operated at speeds considerably in excess of the 1,000 f.p.m. practical limit experienced with such prior art systems. Indeed, with the present invention, forming wire speed is no longer limited by the speed of web formation but, rather, by the speed of such subsequent processing steps as bonding in the web bonding station 85 (FIG. 1).

Experimentation has indicated that a wide range of results are attainable dependent upon the particular operating parameters selected. For example, the rotor assembly 175 may be formed with n rotor bars 181 where n equals any whole integer greater than "1". However, it has been ascertained that fiber throughput—a limiting constraint when attempting to maximize productivity—is a function of rotor speed multiplied by the square root of the number of rotor bars employed—i.e., fiber throughput: $RPM \times \sqrt{\text{No. of rotor bars } 181}$). This relationship will, of course, vary with the particular screen employed; and, has been graphically illustrated in FIG. 8 wherein fiber throughput in lbs./in./hr. (the ordinate) has been plotted at various rotor speeds for each of a 2-bar, 4-bar, and 8-bar rotor assembly (the abscissa) when using both a coarse wire screen 10×2.75; 0.047" wire dia.; 0.059" screen opening; and 46.4% open screen area) and a fine wire screen (16×4; 0.035" wire dia.; 0.032" screen opening; and 38.8% open screen area).

Thus, the line 209 represents the Regressor, or "line-of-best-fit", from which functional relationships between throughput and rotor speed can be determined when using a coarse wire screen of the type described above. Similarly, the line 210 represents the same functional relationships when using a fine wire screen of the type described above. The data thus corroborates experimental findings that rotor RPM can be reduced while fiber throughput is maintained, or even increased, by going, from a 4-bar rotor assembly 175 to an 8-bar rotor assembly 175. However, when using an 8-bar rotor assembly 175, the forming systems seems to be less tolerant of mismatches between forming air and rotor speed; and, where such mismatches occur, fibers tend to accumulate on the sidewalls 199 of the forming zone 79. This is readily corrected by reducing rotor speed, normally by less than 10%, while maintaining forming air constant.

It has further been discovered that both nit levels in the air-laid web 60, and fiber throughput in lbs./hr./in.$^2$, are a function of the percentage of fibrous materials removed from the aerated bed 186 through the full-width separator slot 179 (FIG. 3). Thus, referring to FIG. 9, line 211 graphically portrays the decreasing separation/recycle percentages (the abscissa); while, at the same time, increasing separation/recycle percentages are accompanied by increased fiber throughput in lbs./hr./in.$^2$. Numerical nit levels range from "0" ("excellent"), to "1" ("good"), to "2" ("adequate"), to "3" ("poor") to "4" through "6" ("inadequate" to "nonacceptable"). Such numerical ratings are subjective ratings based upon visual inspection of the formed web 60 and subjective comparisons of pre-established standards.

As the pressure of the recycle air supplied through manifold 191 is decreased and/or as separator slot 179 is widened, thereby modulating the pressure conditions within discharge conduits 192 (FIG. 3) and 77 (FIG. 1) which are maintained at a pressure level below that within the forming head 75 by means of a suction fan (not shown), the amount of fibrous material removed from rotor housing 172 through separator slot 179 is increased. As the percentage of fibrous materials separated and/or recycled increases, nit level in the formed web 60 decreases.

FIG. 9 also shows that the throughput of the forming system was increased from 0.62 lbs./hr./in.$^2$ to 0.96 lbs/hr/in$^2$ while at the same time improving web quality from "poor" to "excellent" by increasing the fiber delivered to the system and increasing the percent recycle.

It has been found that a 2-dimensional air-laid web forming system embodying features of the present invention will, when operating at a proper balance of fiber supply, forming air supply, and rotor speed, not only deliver maximum fiber throughput with minimum recycle, but, moreover, will exert a "healing effect" on basis weight non-uniformities entering the forming head 75. That is, the screen 180, when properly loaded with a moving or transient aerated bed 186 of fibers (FIG. 6), acts as a membrane which tends to equalize or even out the passage of fibers through adjacent incremental widths of the screen. Such "healing effect" is only operative over distances of six inches (6") or less. However, the "healing effect" will tend to reduce the coefficient of variation within a forming head 75 supplied with an air/fiber stream delivered through a partitioned duct 170 of the type shown in FIG. 3—viz., the effect of non-uniformities present within each four inch wide segment of the air stream exiting the partitioned duct 170 will tend to be minimized. The "healing effect" will not function to even out gross irregularities in fiber basis weight over a wide expanse of former widths.

J. Comparison with Prior Art Forming Systems

In order to facilitate an understanding of the significant improvements obtained in terms of productivity when comparing air-laid, dry fiber web forming systems of the present invention with prior art systems, Tables I and II represent the use of either a one meter prior art system (Table I) or the 2-dimensional system of the present invention having a semi-cylindrical screen 18" in circumferential length (Table II) to form webs having basis weights of 14 lbs./2880 ft.$^2$ (bath tissue), 17 lbs./2880 ft.$^2$ (facial tissue), and 26, 34 and 40 lbs./2880 ft.$^2$ (toweling).

TABLE I

PRIOR ART (FIG. 2) FORMER CAPACITIES[1]

| Basis Weight lbs./2880 | Product Type | Forming Wire Speed—ft./min. No. of Fiber Distributors 1 | 4 | 8 | 12 |
|---|---|---|---|---|---|
| 14 | Bath Tissue | 228 | 911 | n.[2] | n.[2] |
| 17 | Facial Tissue | 187 | 750 | n.[2] | n.[2] |

TABLE I-continued

PRIOR ART (FIG. 2) FORMER CAPACITIES[1]

| Basis Weight lbs./2880 | Product Type | Forming Wire Speed—ft./min. No. of Fiber Distributors 1 | 4 | 8 | 12 |
|---|---|---|---|---|---|
| 26 | Towel | 122 | 490 | 981 | n.[2] |
| 34 | Towel | 94 | 375 | 750 | 1125 |
| 40 | Towel | 80 | 319 | 638 | 956 |

[1]The data set forth in this Table I is based upon a fiber throughput capacity of 0.14 lbs./hr./in.$^2$ for a single one meter fiber distributor of the type shown at 148 FIG. 2.
[2]Forming wire speed in excess of 1,200 ft./min. produces unacceptable product having excessively wavy formation Thus, referring first to Table I, it will be observed that a conventional prior art air-laid web forming system of the type shown in FIG. 2 employing only a single fiber distributor 148 is capable of being set to produce a web having a basis weight of 14 lbs./2880 ft.$^2$ at an anticipated average maximum operating speed for forming wire 80 on the order of 228 f.p.m. In order to produce formed webs having progressively increasing basis weights (assuming all other operating parameters remain fixed at the optimum settings), it is merely necessary to reduce the speed of the forming wire 80. Thus, when operating the forming wire 80 at a speed on the order of 187 f.p.m., it is possible to produce a web having a basis weight of 17 lbs./2880 ft.$^2$; while operation at forming wire speeds on the order of 122, 94 and 80 f.p.m. permits formation of toweling grade webs having basis weights of 26, 34 and 40 lbs./2880 ft.$^2$, respectively. Such forming wire speeds (from about 228 to about 80 f.p.m.) are very low for commercial production facilities. However, it is possible to increase the anticipated average maximum speed obtainable by increasing the number of distributor heads 148 employed. For example, a system employing four tandem distributor heads is capable of producing webs ranging from 14 to 40 lbs./2280 ft.$^2$ at forming wire speeds ranging from about 911 f.p.m. to about 319 f.p.m.—i.e., four times the anticipated average maximum speeds attainable when using only a single forming head 148. Such a system, however, generally requires four hammermills and all of the attendant peripheral fiber conveying and recycling systems, together with their inherent disadvantages in terms of capital investment, space, and energy consumption requirements.

Still greater forming wire speeds are attainable with the conventional prior art systems by employing additional fiber distributor heads. For example, eight tandem distributor heads are capable of forming webs having basis weights ranging from 26 to 40 lbs./2880 ft.$^2$ suitable for toweling at forming wire speeds respectively ranging from about 981 to about 638 f.p.m.

TABLE II

2-DIMENSIONAL FORMER CAPACITITES IN ACCORDANCE WITH THE INVENTION[1]

| Basis Weight lbs./2880 ft.$^2$ | Product Type | Forming Wire Speed—ft./min. No. of Forming Heads 1 | 2 | 3 |
|---|---|---|---|---|
| 14 | Bath Tissue | 911 | 1821 | 2737 |
| 17 | Facial Tissue | 750 | 1500 | 2250 |
| 26 | Towel | 490 | 981 | 1471 |
| 34 | Towel | 375 | 750 | 1125 |
| 40 | Towel | 319 | 638 | 956 |

[1]The data set forth in this Table II is based upon a fiber throughput capacity of 1.23 lbs./hr./in.$^2$ for a single forming head of the type shown at 75 in FIGS. 1 and 9, and which uses a relatively fine screen 180 18" in circumferential length and having a screen opening of 0.050".

Referring next to Table II, it will be observed that a single forming head 75 embodying the features of the present invention—e.g., the type shown in FIGS. 1 and 3—is capable of producing similar webs having basis weights ranging from 14–40 lbs./2880 ft.$^2$ at forming wire speeds ranging from about 911 f.p.m. to about 319 f.p.m.—speeds comparable to the speeds obtainable with a prior system requiring four tandem distributor heads. These realistically attainable forming wire speeds may be doubled, tripled, or even further multiplied by using two, three or more forming heads. Consequently, the formation of air-laid webs of dry fibers is no longer limited to low forming wire speeds; and, this is believed to be a direct result of the fiber throughput capacity of each forming head 75 which is capable of delivering in the order of ten times the mass quantum of fibers per square inch of former screen as can be delivered by a single prior art fiber distributing head 148.

K. Examples

Examples I and II (Table III) including the actual operating parameters utilized for formation of the webs of a prior art apparatus and an apparatus of the present invention, respectively.

An interesting comparative analysis may be made between the present invention of Example II and prior art web forming systems exemplified by Example III of Table III. Thus, when contrasting Example II and Example III, it will be noted that both processes produced a facial tissue having approximately the same basis weight. However, the prior art system required two tandem fiber distributor heads—together with the required peripheral hammermills, fiber conveying systems, and fiber recycling systems; as contrasted with Example II wherein the web was formed in accordance with the invention utilizing only a single forming head 75. Yet, fiber throughput in the Example II system embodying the invention was 8.7 times that of the Example III prior art system and, consequently, the speed of forming wire 80 was 500 f.p.m. for Example II as compared to only 250 f.p.m. for Example III. While the nit level of the Example III web produced by the prior art system was "1.1" ("good") as compared to "2.7" (between "adequate" and "poor") for the web 60 of Example II, it was necessary to recycle 34% of the fibrous material input to the prior art system as contrasted with only 5.6% in the Example II system. A large portion of the recycled material was comprised of good fibers which, when hammermilled with the aggregated fiber masses, are shortened and damaged.

TABLE III

| Example No. | I | II | III | IV | V |
|---|---|---|---|---|---|
| Former[1] | C | A | B | A | A |
| Run No. | 1109 | 1113 | 1039A | 2999 | 2940 |
| Fiber Type[2] | NSWK | NSWK | NSWK | NSWK | NSWK |
| Fiber Feed Rate—lbs./in./hr.[3] | 29.2 | 15.9 | 11.3 | 9.8 | 4.6 |
| Top Air Supply—ft.$^3$/min./in. | 420 | 108 | 210 | 112 | 115 |
| Air-to-Fiber Ratio—ft.$^3$/lb. | 823 | 407 | 1115 | 689 | 1500 |
| No. of Rotors | 12 | 1 | 6 | 1 | 1 |
| No. of Rotor Bars/Rotor | ~ | 4 | ~ | 8 | 8 |
| Rotor Speed—RPM | 780 | 1466 | 790 | 1200 | 1550 |
| Screen Type | 10×10<br>12×12 | 11×2.5 | 10×10<br>12×12 | 10×10 | 12×12 |
| Screen Opening—Inches | .075<br>.060 | .050 | .075<br>.060 | .065 | .060 |
| % Open Screen Area | 56.3 | 43.6 | 56.3 | 42.3 | 51.8 |

TABLE III-continued

| Example No. | I | II | III | IV | V |
|---|---|---|---|---|---|
| | 51.8 | | 51.8 | | |
| Former Pressure—Inches $H_2O$ | -0- | 1.2 | -0- | 1.85 | 1.5 |
| % Fiber Recycled | 33.0 | 5.6 | 34.0 | 10.2 | 7.5 |
| Amount Fiber Recycled—lbs./in./hr. | 9.7 | 0.9 | 3.85 | 1.0 | 0.35 |
| Fiber Throughput—lbs./hr./in.$^2$ | .12 | .83 | .095 | .49 | .24 |
| Classifying Air—ft.$^3$/min./in. | -0- | 2.2 | -0- | 1.3 | 1.4 |
| Forming Wire Speed—ft./min. | 600 | 500 | 250 | 300 | 150 |
| Product Made | Facial Tissue | Facial Tissue | Facial Tissue | Exp. | Exp. |
| Bond Pattern | 19/28 | 19/28 | 19/28 | 25/23 | 25/23 |
| Basis Weight—lbs./2880 ft.$^2$ | 18.7 | 17.3 | 17.0 | 16.9 | 17.6 |
| Coefficient of Variation—C.D. % | 2.8 | 4.7 | 4.7 | 3.1 | 1.8 |
| Tensile—Gms./3" C.D. Width | 325 | 460 | 411 | 505 | 357 |
| Nit Level | 4.0 | 2.7 | 1.1 | 1.0 | -0- |

[1]Former "A" is a 2-dimensional former embodying the features of the present invention having a screen 18" in circumferential length. Former "B" is a prior art former of the type shown in FIG. 2, but employing two distributor heads 148 in tandem, one having a 10×10 square-mesh screen and the other having a 12×12 square-mesh screen, and each head being one meter in width. Former "C" is a prior art former of the type shown in FIG. 2, but employing four distributor heads 148 in tandem, alternate ones of such heads respectively having 10×10 and 12×12 square-mesh screens, and all heads being one meter in width.

[2]NSWK is Northern Softwood Kraft.

[3]Fiber feed rates as stated represent maximum former capacity for the operating parameters established.

When contrasting the operating parameters used to generate the webs of Example II and any of the other Examples, one difference is worthy of mention at this point—the type of screen employed. In the case of Example II, the single forming head produced significantly higher throughput rates and employed a slotted screen 11×2.5 having 43.6% open screen area; whereas the other Examples employed woven square-mesh screens 10×10 or 12×12.

Figure 10:
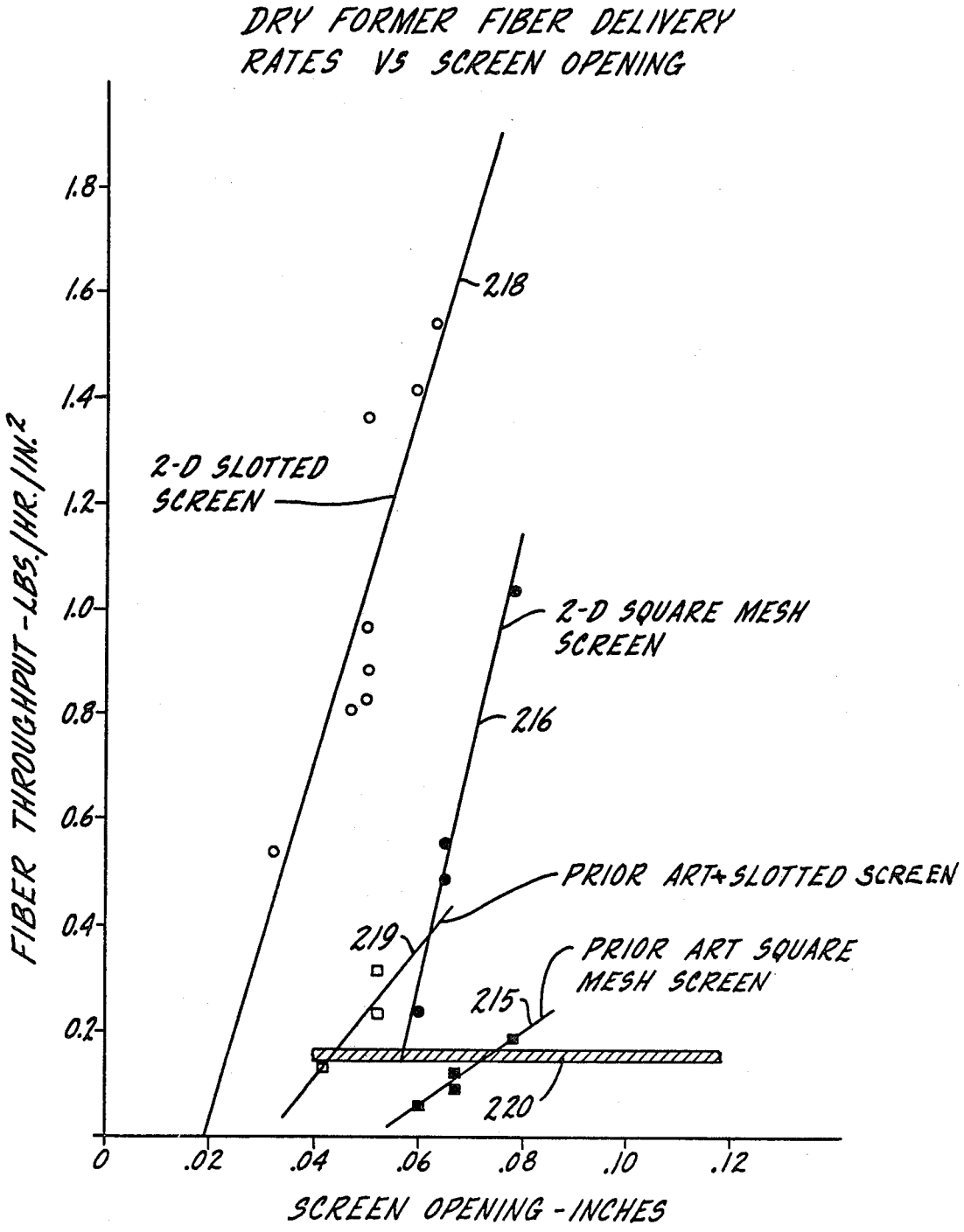
FIG. 10 is a representation depicting the relationship of the fiber delivery rates as a function of screen type in both prior art systems and the present invention.

The dramatic improvement in throughput is evident upon inspection of the data as reproduced in graphic form in FIG. 10. Thus, as here shown fiber throughput has been plotted against the screen opening size in inches as determined in experiments run by applicant. The line 215 is thus representative of fiber throughput when using woven square-mesh screens in a conventional prior art system, and the remarkably improved throughput achieved with the present invention when using woven square-mesh screens is reflected by the line 216.

Even more remarkable throughput rates are attained when utilizing a slotted screen of FIG. 5 with a 2-dimensional former of the present invention as reflected by line 218.

Surprisingly, although slotted screens produce improved throughput when used with the present invention only when the slots are oriented parallel to the axis of the rotor assembly, such orientation has been found to be not critical when working with prior art forming systems of the type shown in FIG. 2. Thus, data recorded in experiments using a prior art system with a slotted screen has been used to generate the line 219 in FIG. 10. It should, however, be noted that the present invention permits of greater throughput and, therefore, greater productivity, even when using woven square-mesh screens than do the prior art systems when using slotted screens (Cf., lines 216 and 219 in FIG. 10).

Finally, reference is made to the cross-hatched line 220 in FIG. 10 which is indicative of maximum throughputs obtainable with multiple head prior art web forming systems. Such data has been reported in publications, although the data does not reflect the particular screen characteristics used.

Figure 11:
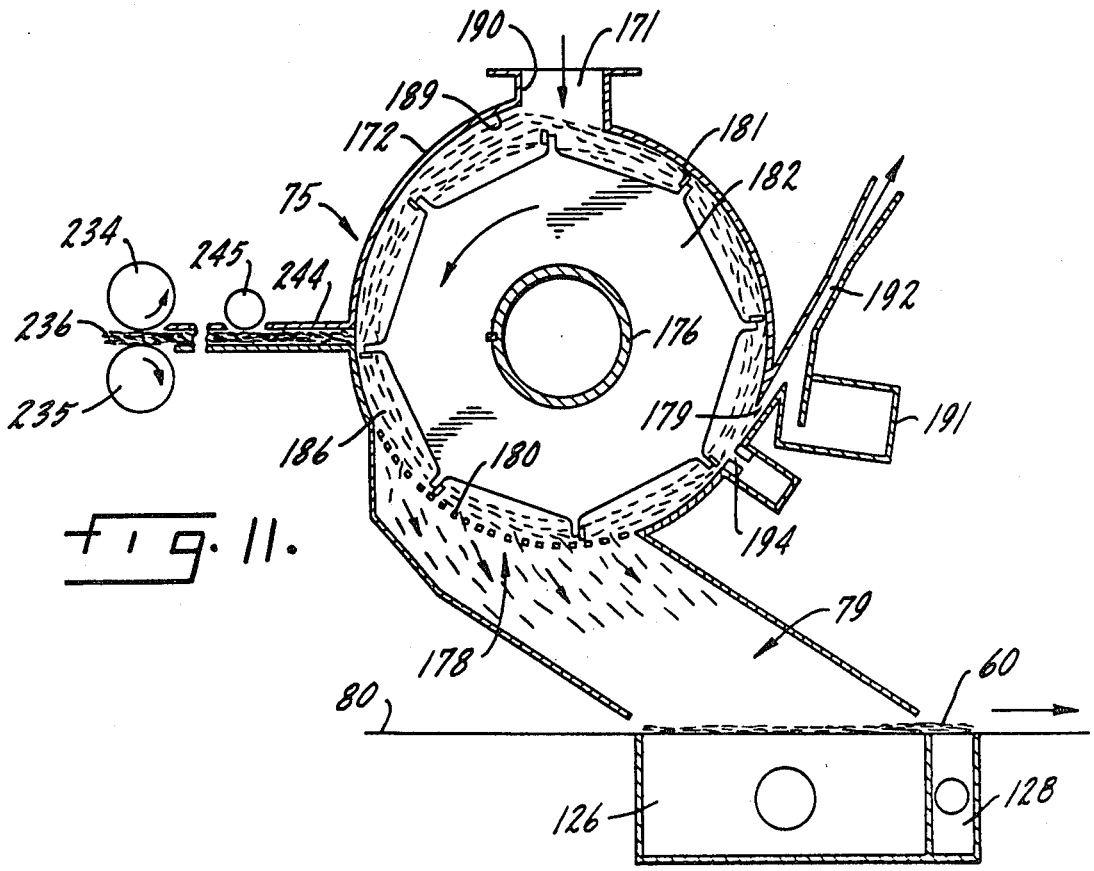
FIG. 11 depicts a modified embodiment in which a lightly compacted feed mat is fed directly into the rotor chamber.

Turning next to FIG. 11, there has been illustrated one form of system for feeding a lightly compacted feed mat having a controlled C.D. coefficient of variation directly into a forming head 75 embodying features of the present invention. As here shown, a feed mat such as that shown at 116 in FIG. 3 is first conveyed between a pair of full-width compacting rolls 234, 235 which serve to lightly compact the web 116 so as to form a feed mat 236 characterized by its full-width uniformity and having a coefficient of variation of 5% or less. The compacting rolls 234, 235 are hardened steel rolls and are adjusted so as to provide sufficient web compaction to form a feed mat 236 having enough integrity to permit subsequent handling; yet, not sufficient compaction as to cause hydrogen bonding of individual fibers. For example, when working with Northern Softwood Kraft (NSWK) fibers, it has been found that the requisite degree of compaction can be achieved with compacting forces on the order of 200 to 800 p.l.i. (pounds per lineal inch) when using two equal diameter hardened steel rolls 234, 235, each 6" in diameter.

In carrying out this modification, the lightly compacted feed mat 236 of non-bonded fibers thus formed is fed through a full-width feed inlet 244 radially into rotor housing 172 by means of a feed roll 245. The feed inlet 244 is preferably positioned downstream of air inlet 171 and upstream of discharge opening 178. The arrangement is such that as the feed mat 236 enters housing 172, it radially intersects the aerated bed 186 of fibers which is moving at a relatively high velocity such that the lightly compacted fibers of feed mat 236 are instantaneously and uniformly dispersed into the bed 186 of fibers.

The fibrous materials are, thereafter, selectively passed through screening means 180 disposed in outlet 178 or, alternatively, through full-width tangential separator slot 179, in the manner previously described. Those fibers passing through screening means 180 are conveyed through forming zone 79 and are air-laid on foraminous forming wire 80 to form web 60. It will be noted that in this arrangement, those fibers freshly introduced into the housing 172 through inlet 244 will, at least initially, be principally located within the radially outermost regions of the aerated bed 186 and, consequently, will be in close proximity to the screening means 180; whereas those fibers not discharged through the screen 180 on the first pass will tend to be principally located in the radially innermost regions of the aerated bed 186 of fibers. Consequently, it is believed that this arrangement will permit relatively high forming capacity since a high mass quantum of fibers are dispersed in the outermost regions of the aerated bed just upstream of the screening means 180 where they will have immediate access to the screening means. Alternatively, the lightly compacted feed mat 236 may be tangentially introduced into head 75 in the same position as the mat is feed radially in FIG. 11, or the fibers of lightly compacted feed mat 236 may be fed into the lower end of conduit 170 after being opened by a full width lickerin located adjacent conduit 170.

It is anticipated that acceptable results may be obtained by providing the screen 180 with a radius of curvature substantially greater than that of the rotor assembly 175, and offsetting the axes of rotation of rotor assembly 175 from the geometric center of head 75, such that the rotor bars coverage toward the screen and more heavily load the aerated fiber bed 186 and increase the fiber throughput.

It is also anticipated that the forming surface may take the form of a perforate or foraminous rotatable cylinder provided with an internal vacuum. One or more forming heads 75 could be mounted in series thereon.

Of course, the forming head 75 may be mounted in any desired configuration above the forming wire 80, i.e. at a 90° angle to that shown in FIG. 3, producing a relatively narrow, high basis weight web, at a high forming wire speed. The forming head may likewise be angularly related to the forming wire in any manner producing the basis weight profile desired.

Those skilled in the art will appreciate that there has herein been described a novel web forming system characterized by its simplicity and lack of complex, space-consuming, fiber handling equipment; yet, which is effective in forming air-laid webs of dry fibers at commercially acceptable production speeds irrespective of the basis weight of the web being formed. At the same time, the absence of cross-flow forces insures that the finished web possesses the desired controlled C.D. profile which may be either uniform or non-uniform.

I claim:

1. The method of forming a web of airlaid dry fibers comprising:

(a) feeding a quantity of air-borne fibrous materials having uniform cross direction basis weight profile to at least one rotary forming head having a plurality of rotating rotor bars therein;

(b) maintaining said fibrous materials within said at least one forming head in an aerated fiber bed such that damage to said fibrous material within said at least one forming head is substantially avoided;

(c) separating from one percent to ten percent of said fibrous materials in the form of aggregated fiber masses from said aerated fiber bed and discharging said aggregated fiber masses from said at least one forming head through a tangential slot therein, said aggregated fiber masses having a bulk density of at least 0.2 g/cc;

(d) discharging said fibrous materials from said at least one forming head through a screen member and thereafter conveying said fibrous material through an enclosed forming zone to a foraminous forming surface at the rate of from about 0.5 lbs/hr. per square inch of screen member to at least 1.55 lbs/hr/per square inch of screen member to form a web of fibers;

wherein said web of fibers produced therefrom is characterized by a uniform cross-direction basis weight profile and is substantially free of aggregated fiber masses.

2. The method as described in claim 1, further comprising conveying said air-borne fibrous materials to and through said rotary forming head in an environment devoid of cross-flow forces, such that the cross-direction basis weight profile of said web may be controlled by the cross-direction basis weight profile of the fibrous materials presented to said forming head.

3. The method as described in claim 2, wherein the cross-direction coefficient of variation does not vary more than 5%.

4. The method as described in claim 1, further comprising suspending said fibrous materials conveyed to said forming head in an air stream in a concentration of from about 0.1 lbs to about 3.0 lbs. of fibers per 100 cubic feet of air.

5. The method as described in claim 1, further comprising maintaining said aerated fiber bed within said forming head by rotating said rotor bars at a tangential speed approximately twice the speed of said air-borne fibrous materials fed into said forming head.

6. The method as described in claim 5, further comprising providing a pressure drop of from about 0.5 inches to about 3.0 inches of water across the screen member, said pressure drop resulting from maintaining a positive pressure within said forming head of from about 0.5 inches to about 3.0 inches of water.

7. The method as described in claim 6, further comprising providing a negative pressure zone in the wake of each rotor bar, said negative pressure zone being at least as great at the pressure drop across said screen member, such that the air/fiber flow through said screen member beneath said negative pressure zone is disrupted, thereby lifting fibers from said screen member.

8. The method as described in claim 1, further comprising feeding air-borne fibrous material to said forming head through a full width fiber transport duct having a plurality of spaced-apart partitions separating said duct into a plurality of separate adjacent flow channels.

9. The method as described in claim 8, further comprising providing said duct with one end having a greater cross-direction width that the other end such that the width of the web produced is different from the width of air-borne fibrous materials fed into said transport duct.

10. The method as described in claim 1, further comprising conveying said fibrous material from said forming head to said foraminous forming surface through an enclosed forming zone provided with substantially parallel full width upstream and downstream wall means which intersect a line upstream and downstream wall means which intersect a line tangent to the midpoint of said screen member with an included acute angle $\alpha$ and which intersects said foraminious forming surface with an included angle $\beta$.

11. The method as described in claim 10, further comprising providing said acute angle $\alpha$ in the range of 5° to 20°.

12. The method as described in claim 10, further comprising providing an acute angle $\beta$ of approximately 33°.

13. The method as described in claim 1, further comprising providing said screen member with screen openings less than 0.1 inch in at least one direction, and with from 30% to 55% open area.

14. The method as described in claim 1, further comprising supplying classifying air radially into the rotary forming head to divert individualized fibers and soft fiber flocs radially inward within said aerated fiber bed, said classifying air being supplied at a pressure of from about 30 inches of water to about 120 inches of water.

* * * * *